US005625398A

United States Patent [19]

Milkovits et al.

[11] Patent Number: 5,625,398

[45] Date of Patent: Apr. 29, 1997

[54] THIN, SHALLOW-ANGLE SERRATED HOLD-DOWN WITH IMPROVED WARMING, FOR BETTER INK CONTROL IN A LIQUID-INK PRINTER

[75] Inventors: Joseph P. Milkovits, San Diego; Craig A. Maurer, Oceanside, both of Calif.

[73] Assignee: Hewlett-Packard Company, Palo Alto, Calif.

[21] Appl. No.: 236,433

[22] Filed: May 2, 1994

Related U.S. Application Data

[63] Continuation-in-part of Ser. No. 57,364, Apr. 30, 1993, abandoned.

[51] Int. Cl.[6] ..... B41J 2/01

[52] U.S. Cl. ..... 347/104; 347/25; 347/34; 347/102

[58] Field of Search ..... 347/8, 21, 22, 347/34, 102, 104, 25

[56] References Cited

U.S. PATENT DOCUMENTS 5,065,169 11/1991 Vincent ..... 347/8
5,296,873 3/1994 Russell ..... 347/102 X

*Primary Examiner*—Joseph W. Hartary

[57] ABSTRACT

The invention minimizes liquid-ink deposition on the top and edge of a guide-plate (or "hold-down" plate), and also minimizes running of deposited liquid ink along the top to the edge. Through these two effects together the rate of ink deposition on the top and edge of the plate is held below the volume of ink per unit time that can dry there. The invention also minimizes ink transfer from the edge onto the print medium. The deposition-minimizing provisions include two features: serration, and a very fine vertical dimension of the edge itself. These features enhance air flow, and thus transport of ink spray, rapidly across the edge—discouraging formation of a dead-air zone from which spray readily precipitates onto the edge. The thin edge also presents a smaller direct target for ink droplets. The serrations may enhance transport by (1) promoting a more-favorable balance between laminar and turbulent flow; or (2) enabling air passage between opposed surfaces of the plate—from underside to top surface—creating an updraft to lift the flow away from the edge; or (3) both. To minimize running of liquid ink along the plate, the plate is mounted essentially all exposed to heat from a heater whose main purpose is drying ink on the print medium: this raises the plate temperature and so promotes drying of ink on the plate too. To further minimize running of liquid ink along the plate toward the edge, the edge panel is at a very shallow angle; and the air-flow provisions mentioned above also help carry away liquid carrier, from whatever ink does fall onto the edge, thus accelerating drying. To minimize brushing off even a slight accumulation of ink (liquid or dry) onto the medium, the serrations also raise most of the edge away from the medium.

33 Claims, 7 Drawing Sheets

THIN, SHALLOW-ANGLE SERRATED HOLD-DOWN WITH IMPROVED WARMING, FOR BETTER INK CONTROL IN A LIQUID-INK PRINTER

RELATED PATENT DOCUMENT

This is a continuation-in-part of co-assigned U.S. utility-patent application Ser. No. 08/057,364, entitled "COMBINED CENTRAL AND LATERAL HOLD-DOWN PLATES, AND END-OF-PAGE ADVANCE-DISTANCE DECREASE, IN LIQUID-INK PRINTERS", filed Apr. 30, 1993, in the names of Damon Broder et al. (one of whom is the lead inventor in the present document) and abandoned in favor of file-wrapper continuing application Ser. No. 08/417,510, filed Apr. 4, 1995. That document in its entirety is hereby incorporated by reference into the present document.

BACKGROUND

1. Field of the Invention

This invention relates generally to machines and procedures for printing text or graphics on printing media such as paper, transparency stock, and other glossy media; and more particularly to apparatus and methods that construct text or images from individual marks created on the printing medium, in a two-dimensional pixel array, by a pen or other liquid-ink-ejecting marking element or head that scans across the medium.

The invention is particularly beneficial in printers that operate by an inkjet process. That process discharges individual ink drops onto the printing medium.

2. Related Art

U.S. Pat. No. 5,065,169, of Vincent et al., introduces the importance of controlling pen-to-printing-medium distance, and flatness of the medium, in an inkjet printer. Vincent discloses one way of performing those functions by means of a spacer formed as a skid, roller or the like that travels with the pen.

Systems following Vincent addressed a more-difficult problem of performing like functions in staggered-multiple-pen systems—where traveling skids or rollers were problematic due to the tendency of the roller or skid on a trailing pen to smear the ink laid down by a leading pen. These later systems provided stationary hold-down plates, sometimes called "shims", intended to restrain the print medium against print-medium deformation such as curl or cockle.

Such systems were not fully effective in controlling such deformation. As a result those systems were sometimes subject to print-medium crashes, particularly near the leading edge of each sheet, and degraded image quality due to curling and other flight-time-related errors—particularly along the lateral edges over the full height of each sheet.

These limitations were especially noteworthy in conjunction with use of ink-drying heaters and ink-spray-removal blowers—modern developments whose objects are to reduce drying time for nonabsorbent media and to carry away waste ink spray, but which unfortunately have some tendency to aggravate curl and cockle. Waste ink is common in inkjet systems in the air above the print medium, whether persisting as minute spray droplets or present as recondensable vapor, and is advantageously carried off gently in an exhaust air stream to avoid its deposition onto the printing medium.

The above-mentioned related patent document of Broder et al. heralded a significant improvement in hold-down-plate arrangements for controlling pen-to-print-medium distance and print-medium flatness. The Broder system accommodates operation of staggered multiple pens, without smearing of leading-pen marks by trailing pens. It also accommodates such pens when used to print on glossy media, and with a print-zone heater and spray-removal blower, while controlling print-medium deformation and avoiding so-called "paper crashes".

Broder et al. obtained these improvements by introducing a dual guide system of central and lateral hold-down plates that restrain the print medium in a coordinated way. The central plate is upstream from the pen or pens, in part angled longitudinally down into contact with the print medium, and extends laterally across the width of the medium except in one or more regions that are laterally near the engagement of a print-medium advancing device.

The other, lateral, guide system is positioned laterally outboard from the pen, and extends laterally across the medium only in one or more regions laterally near the engagement of the advancing device. These "one or more regions" preferably are only near the lateral edges of the medium.

Thus the two guide systems complement each other in function. The first guide restrains the medium over an area that stops short of the lateral edges of the medium; and the second is preferably bifurcated and disposed laterally in two directions from the pen, restraining the medium across only its lateral edges.

Despite these very favorable developments due to the teachings of Broder et al., certain imperfections have been noted in the quality of documents printed with the described system. In particular, spurious ink marks occasionally appeared in the printing—often transverse straight lines, generally at various regions of the printing-medium width and in the color of whatever ink was being used in the printer.

The appearance of these linear markings was erratic in time, and seemed to neither correlate with any feature of the document being printed nor exhibit the characteristic pixel structure of the inkjet printing process. The marks, however, were very evidently associated with quantities of liquid ink seen on the top surface of the horizontal panel 121*h* (FIGS. 8 and 9) and angled panel 121*a* of the central hold-down plate 121, and ink I which was seen running down the angled parts 121*a* of its top surface toward the straight edge 121*e* of the plate, and indeed on the edge 121*e*—from which ink was being transfered from the edge to the printed sheets 30. The upper one of the angled panels 121*a* is particularly steep, about twenty-five degrees from horizontal.

In the earlier configurations in which these phenomena were observed, the guide plate 121 was mounted above an adjacent plenum cover 50 (in this document not distinguished from the plenum generally) and pressed very lightly though firmly on the printing medium 30. The guide plate 121 included a generally horizontal panel 121*h*, and downward angled panels 121*a*—terminating in a straight, blunt edge 121*e*.

A rear panel 121*r* served to stiffen or rigidify the guide plate 121. A section 50*r* of the plenum cover 50, roughly several centimeters from the print zone Z, was bent upward to help hold thin plastic paper guides (not shown) below the cover, leaving a narrow window 50*w* in the plenum cover 50.

The medium 30 advanced (from left to right in FIGS. 8 and 9) above a supporting grill 73 with orifices 74 and beneath the pens 10—while the pens 10 traversed along a direction which in FIG. 8 is in and out of the plane of the paper. Nozzles 11 forming part of each pen 10 discharged ink toward the top surface of the print medium 30 in the print zone Z.

A preheater 78' and a heater 78 shown schematically to the left of and below the supporting grill 73 were provided to predry the print medium and to speed drying of ink deposited on the printing medium 30—to form a desired image. Air was moved slowly and gently from right toward left (as drawn in FIGS. 8 and 9) to carry away waste ink spray as droplets, and possibly components of the ink formulation in vapor form. This air movement was provided by a blower—not shown, but along a path that begins with the plenum structure 50 at left in the drawings—which sucked air 161 away from the unprotected and already-imprinted regions of the print medium, across 162 the print zone Z and into the plenum 165 toward 168 the blower.

In relation to the direction 33 of print-medium 30 movement, the hold-down guide 121 was at all times upstream from the pens 10. Thus it was not physically possible for the guide 121 to pick up ink by brushing it from the medium 30; and there was no path for ink migration directly from pen reservoirs to the guide plate 121.

The source of this ink deposit was accordingly recognized as precipitation of waste ink from the air in the print zone Z. In a representative inkjet printer, as outlined above, a blower moves that air slowly away from the print zone Z to prevent significant amounts of the spray from falling, precipitating or otherwise being deposited onto the sheet being printed.

This ink-spray-transporting air flow is preferably routed away from unprotected areas of the document—where the waste spray might settle onto those areas and so spoil the printed image. No protective structure is present or desirable in the downstream direction, which is to say the direction 33 of print-medium 30 advance; but the hold-down plate 121 offers to serve as a shield over the print medium in the opposite, upstream direction.

It is for this reason that advantageously the drying-air flow 161–168 is made to flow in that opposite direction, toward 162 and past (above) 165 the hold-down plate 121—or in other words counter to the direction 33 of print-medium 30 movement.

As can now be appreciated, this configuration was originally thought to have disposed of the waste-ink spray with some finality. In the more-demanding environment of close curl/cockle control and high image throughput, however, the same waste spray can come back to haunt the system.

The plate 121, while thus upstream along the direction 33 of printing-medium 30 movement, is downstream along the direction 161–168 of air movement created by the drying blower. Hence the waste ink spray moves toward, and should move over and past, the plate 121—into the blower plenum structure 50 where it can harmlessly precipitate or be filtered out of the air stream, or both.

As will now be understood, the above-mentioned ink deposits, ink flow I, and undesirable markings all resulted from failure of some of the waste ink to pass completely over and beyond the guide plate 121.

Less clear, heretofore, was why this ink was building up where it was, on the plate 121 immediately adjacent to the print zone Z; and what could be done to prevent it from doing so or neutralize its effects; and how such preventive measures might be implemented. As can now be seen, important aspects of the technology which is used in the field of the invention are amenable to useful refinement.

SUMMARY OF THE DISCLOSURE

The present invention introduces such refinement. It resolves the mechanisms of ink appearance on the guide-plate top surface and edge—and goes on to offer simple but elegant arrangements for interfering with those mechanisms and so substantially eliminating the objectionable markings.

Before offering a relatively rigorous discussion of the present invention, some informal orientation will be provided here. It is to be understood that these first comments are not intended as a statement of the invention.

A portion of the creative contribution associated with the present invention is believed to reside in understanding and explaining the accumulation of ink on the guide plate, and its transference to the printing medium. To control print-medium deformation, the guide plate 121 (FIGS. 8 and 9) must gently but firmly contact the medium 30; and in production of modern high throughputs the amount of spray generated is greater than ever before.

The blower was provided to suck this relatively large quantity of fine ink spray, and perhaps some vapor, above and across the guide-plate edge 121*e* into the exhaust plenum structure 50. The desired air flow across the edge 121*e*, however, was evidently perturbed by creation of a dead-air zone 163 at the edge 121*e* of the guide plate 121.

We believe that the relatively tall (0.2 mm), blunt edge 121*e* of the plate 121 in earlier configurations tended to promote this dead-air region 163. It appears to us that ink particles or vapor, or both, were trapped in or at least decelerated by this dead-air zone 163.

From this zone 163 the particles and/or vapor evidently dropped and/or condensed onto the top surface of the plate 121, near the edge 121, and also directly onto the edge 121*e* of the plate (and in some cases perhaps even directly onto the printing medium 30). Particles and/or vapor that were only decelerated at, rather than trapped in, the dead-air zone 163 perhaps fell from the emerging stream 164 onto the top of the plate 121 somewhat further from the edge 121*e*.

As will be understood, air 164 just emerging from the dead zone or climbing to detour above it might well have a forward velocity component significantly lower than in other segments of the flow path. In any event, ink deposited on the top of the plate 121 and near its edge 121*e*, in liquid form—more quickly than it could dry there by evaporation of its liquid carrier. Also, at system startup the cool plate 121 promotes condensation.

At the same time the blunt edge 121*e* of the guide plate 121 formed a relatively tall target of opportunity for stray ink drops or vapor. We believe that a part of the marking problem arose from direct deposition onto this edge 121*e*.

In any event deposition on the top surface of the plate 121 continued until a critical accumulation of liquid was reached—at which point there was enough volume of ink to run as liquid ink I down the inclined surfaces 121*a* of the plate, toward and to the edge 121*e* of the plate. Then the ink was transfered or brushed off from the straight edge 121*e* of the plate, either as liquid flow or as solid, dried ink, onto sheets 30 being printed.

It will be appreciated that one satisfactory solution is not simply to reverse the blower direction 161–168. Clearly some other arrangement is needed if one intends to entirely prevent deposition of waste ink on the guide plate 121, for reversing the air flow would simply resurrect the originally recognized problem of ink-carrying air dropping waste spray onto finished parts of the printing.

On first glance at FIGS. 8 and 9 it might be supposed that a solution to this problem could be found in rerouting the air flow upward into a tighter contour next to the pen or pens. In such a configuration for example the air might be moved in either longitudinal direction relative to the print-medium path, and/or perhaps even laterally (in and out of the plane of FIG. 8).

Such solutions, however, would require a major restructuring of the system hardware—possibly including even the printer cabinet. Even beyond daunting cost considerations, the full repercussions of such a fundamentally different plumbing geometry would likely include a succession of other new difficulties involving noise, vibration, and operator and maintenance access to the pen, as well as myriad unanticipated problems.

Instead a solution has been reached that is confined—in area, character and scope—to the dimensions of the problem. That solution recognizes the root problem as aerodynamic and liquid-dynamic, in particular relating to:

entrapment of ink droplets or vapor, or both, in a dead-air zone 163 at the edge 121*e* of the guide plate 121, from which zone 163 (and the immediately following flow region 164) the droplets/vapor dropped/condensed onto the top and edge 121*e* of the plate 121;

running of the thus-deposited liquid ink I from the top of the plate 121 toward its edge 121*e*; and brushing/running off, of ink in liquid/dry form(s) from the edge 121*e* onto the medium 30.

The solution further includes defending against each of these mechanisms by a relatively subtle restructuring of the guide system itself. This restructuring provides respective means for minimizing deposition of ink on the top and edge of the plate, minimizing running of ink along the top of the angled panels (and preferably eliminating the steeply angled panel), and minimizing transfer of ink from the edge onto the printing medium.

These three means include in part an aerodynamic reconfiguration of the critical edge of the guide plate, and in part a related simple reconfiguration of the mounting of that plate. The earlier plate edge 121*e* is straight and continuous, providing no path for updraft of air from beneath the plate 121: such a path if present could have helped disrupt dead air 163 at the interface, as well as drying ink along the edge 121*e* itself.

Furthermore the earlier positioning of the guide-plate 121*h* horizontal-panel attachment region at the top of the exhaust-plenum cover 50 tended to isolate the plate 121 thermally from the paper-preheater 78' and the ink-drying heater 78 in its enclosure 71—it being understood that despite the solid walls 72, 77 about the heater space 71 considerable heat does radiate and convect 76 to the walls 72, 77 and thence toward the underside of the plenum cover 50. The result of this positioning was a relatively low guide-plate 121 temperature, and accordingly a tendency to keep the deposited ink in liquid form long enough for it to run as liquid ink I to the edge 121*e*.

A comparatively steep angle B (FIG. 8) of the lower of the two angled panels 121*a*, relative to the horizontal, was another factor aggravating the tendency of the guide plate 121 to serve as a ramp for running of the liquid downward—leading liquid ink I toward the print medium 30. Steeper angles increase the rate of ink flow I toward the medium relative to the rate of ink-carrier evaporation; in earlier apparatus the edge angle B, when the edge was not deflected by contact with such printing medium, was in the range of eight to nine degrees.

Further the upper of the two angled panels 121*a* was at a very steep inclination of about twenty-five degrees. This angle led to very rapid flow down that panel and liquid accumulation on the lower angled panel.

Furthermore the plate 121 had a straight edge 121*e*, across the full width of the printing medium 30. As a result any ink arriving at the edge 121*e* of the plate—by the mechanisms just described—was essentially placed in contact with the print-medium 30 surface and very likely to be brushed off (as for example by movement of the medium 30 itself), or perhaps even shaken off, onto the printing medium 30.

Reversing these several adverse influences provides several potential corrective factors. Such correcting effects in combination have been found to very greatly reduce or eliminate—depending on the quantities of ink discharged in a given user's applications—the incidence of the objectionable markings described above.

In all cases the invention reduces ink deposition at least to the point that the problem is eliminated with occasional operator intervention to clean the plate. The invention also appears to facilitate such cleaning.

Now with these preliminary observations in mind this discussion will proceed to a perhaps more-formal summary. The invention has several main aspects or facets, which are capable of practice independently of one another; however, for best enjoyment of the advantages of the invention they are preferably practiced together.

In preferred embodiments of all these major facets or aspects, the present invention is apparatus for printing images, by marking with a liquid-base ink, on a printing medium. This apparatus includes some means for supporting the medium: for purposes of breadth and generality in describing the invention, these means will be called simply the "supporting means".

The apparatus also includes a marking head disposed for marking on the medium; and some means for engaging the medium and for advancing the medium, in a particular direction, past the marking head. Again for purposes of generality and breadth of description we will call these last-mentioned means the "engaging and advancing means".

In addition the apparatus has some means for vertically restraining the medium—in an area that is upstream from the marking head in relation to the above-mentioned "particular direction" of medium advance. For generality these means will be designated the "guide means". The guide means have a print-medium-contacting edge.

Also included in the apparatus are some means for establishing, above the medium and the guide means, air flow to carry airborne waste ink away. These "air-flow establishing means" operate to carry the waste ink away from the marking head in a direction that is counter to that same "particular direction" of medium advance.

Now we shall refer in particular to apparatus according to preferred embodiments of a first primary facet or aspect of the invention. In addition to the common elements introduced in the preceding four paragraphs, this apparatus also includes some means for minimizing deposition of ink from the air flow onto the guide means. Once more for breadth and generality, we shall refer to these means as the "deposition-minimizing means".

The foregoing five paragraphs may be a description or definition of preferred embodiments of the first main aspect of the present invention in its broadest or most general terms.

In preferred embodiments of a second main facet of the invention, the apparatus includes—in addition to the common elements already enumerated—some means for minimizing running of liquid ink along the guide means toward the edge. These will be called, for the reasons suggested earlier, the "liquid-running minimizing means".

This may constitute a description or definition of preferred embodiments of the second main aspect of the invention in its most broad or general terms.

In preferred embodiments of a third primary aspect or facet of the invention, in addition to the common elements the apparatus includes some means for minimizing transfer of ink from the guide-means edge onto the medium. These will be called the "transfer-minimizing means".

This may serve as a description or definition of preferred embodiments of the third main aspect of the invention in its most general or most broad terms.

In preferred embodiments of still a fourth major facet or aspect of the invention, the apparatus includes (together with the common elements) a plenum cover disposed upstream of the marking head in relation to the particular direction of medium advance; and the guide means are mounted to the undersurface of this plenum cover. The apparatus according to this fourth aspect of the invention also includes serrations defined in the guide-means edge.

Further the edge has a very fine vertical dimension, and is at a very shallow angle of disposition relative to the horizontal. This may be a description or definition of preferred embodiments of the fourth major aspect of the invention in its broadest or most general form.

Even in such general or broad forms, however, as can now be seen each of the main aspects of the invention resolves an important part of the previously outlined problems of the prior art.

In particular by operation of the deposition-minimizing means discussed above in relation to the first main facet of the invention, the amount of ink depositing on and near the guide-means edge can be kept well below what can effectively dry there before it is able to run as liquid to the edge. As to the second primary aspect, the liquid-running-minimizing means defend against the overall problem at a different point in its development, by keeping to a very small value the amount of ink that is able to run to the edge.

The transfer-minimizing means—introduced above in connection with the third main aspect of the invention—form still another line of defense. They mitigate the undesirable effects that arise from any ink that does arrive at the guide-means edge.

As to the fourth main aspect of the invention, the mounting to the plenum cover, serrations, fine edge, and shallow angle all have beneficial effects as will be seen. Together they are successful in reducing the marking problem to an acceptable degree.

Preferred embodiments of the several independent aspects of the invention in their broadest forms thus provide very significant advances relative to the prior art. Thus as noted earlier each of the main aspects of the invention may be practiced alone to gain a significant amelioration of the marking problem described above, and possibly for a given printing system any one alone, or any two alone, could be sufficient to provide satisfactory results.

Nevertheless for greatest enjoyment of the benefits of the invention we prefer to use all the several independent aspects of the invention together in conjunction. Interestingly as will be seen at least one simple physical feature of apparatus according to our invention participates in forming more than one—and possibly all—of the beneficial means introduced in this section. (That physical feature is the serrated edge discussed below.)

Moreover the invention is preferably practiced in conjunction with certain other features or characteristics which enhance its benefits. We prefer, for example, that the deposition-minimizing means of the first aspect of the invention include some means for enhancing air flow past the guide-means edge.

These means—again in the interest of generality the "air-flow enhancing means"—aid in carrying ink spray rapidly away from the critical edge region. Thus they deter formation of a dead-air region from which ink can readily deposit onto the guide-means edge as in earlier apparatus.

We further prefer that the air-flow enhancing means include serrations defined in the guide-means edge. With respect to only the air-flow enhancing means, we believe that these serrations operate advantageously by one or both of two mechanisms:

enabling passage of updraft air between opposed surfaces of the guide means—i.e., from the underside of the guide means to the top surface of the guide means—thus potentially facilitating deflection of ink-bearing air flow away from the guide-means edge (and thus onward toward the exhaust plenum mentioned earlier);

promoting a favorable balance as between laminar and turbulent flow, for purposes of moving the waste ink more smoothly and swiftly past the troublesome area (and safely into the plenum).

The air-flow enhancing means further preferably comprise a very fine vertical dimension of the guide-plate edge; this further reduces the dead-air-zone tendency of the system. At the same time the fine edge may also present a less-probably-struck target for randomly falling spray droplets or condensing vapor, so that deposition directly onto the critical edge itself is minimized.

Impingement of waste ink on the top of guide means, even closely adjacent to the edge, may be less severe than impingement on the very edge. (The reasons for this will become clear shortly in discussion of the liquid-running minimizing means associated with the second major aspect of the invention.)

Even some very slight direct impingement on the print medium, just adjacent to the edge of the plate, may be less severe than impingement on the edge of the plate—since for each image area of the print medium such slight direct impingement would be extremely light and would be incremental rather than cumulative. If it is possible for ink to deposit directly on the edge (this possibility will be discussed below) then such a direct deposit, by comparison, is more likely to cause problems after protracted accumulation, when the quantity that can transfer onto the printing medium all at one time is large enough to create a severely conspicuous mark.

The preceding paragraphs show that deposition in either direction from the vertical edge of the guide means may be preferable to deposition directly on the edge. Hence the small-"target"-edge phenomenon can possibly be a favorable and significant effect—although as noted elsewhere in this document the accuracy of this theory does not alter the effectiveness of our invention.

Now we turn to preferable features related to the "liquid-running minimizing" means introduced above—in connection with the second aspect of the invention. These means are addressed to mitigating the effects of whatever ink does accumulate despite action of the deposition-minimizing means.

As will be appreciated, these "liquid-running minimizing means" effectively serve as a second line of defense. We consider it preferable that the liquid-running minimizing means include a very shallow angle of disposition of the guide-means edge, relative to the horizontal.

Quantitative evaluation of this condition is discussed later in this document. The mechanism by which the shallow angle deters running of liquid ink is simply to reduce the gravity-force component which is directed along the surface of the guide means—and so reduce the acceleration, due to gravity, of ink along that surface toward the edge.

In principle the present invention is not limited to use in a printer system that includes a heater for applying heat to the print medium. A typical modern system, however, does include such a heater, for applying heat to the medium—generally at or near a print zone—to promote drying of ink on the medium.

When our invention is used in such a system, we also deem it particularly preferable that the liquid-running minimizing means include disposition of substantially the entire guide means generally exposed to heat from the ink-drying heater. Such disposition promotes relatively rapid drying of ink that deposits on the guide means. The nature of this heat exposure is made more clear through discussion in greater detail later in this document.

The operative mechanism here is to quickly dry, and thus stabilize, any ink on the guide-plate top surface: what dries in place cannot run to the edge. To enhance this effect, we prefer to attach the guide means at the undersurface of the plenum cover—rather than above the cover as previously.

Still further the liquid-running minimizing means preferably include air-flow enhancing means such as already discussed above in connection with the deposition-minimizing means of the first major aspect of the invention. Enhancement of air flow does double duty in this way because the enhanced flow—in addition to deterring deposition—more effectively dries ink already deposited on the guide plate.

Thus for example the serrated edge discussed earlier, whether its operative mechanism includes updraft generation or adjustment of laminar/turbulent-flow proportions, tends to help transport away liquid carrier from whatever quantity of ink does fall onto the guide-means edge. This effect amounts to rapid drying of that deposited material, and thereby deterrence of liquid flow along the guide means to the print medium.

The air-flow enhancing means, operating in conjunction with the heater to rapidly dry ink at and next to the very edge of the guide means, make it relatively unlikely that ink can long persist on the edge in liquid form. It is this fact that makes impingement of waste ink on the top of the guide means—even immediately adjacent to the edge—relatively "less severe" as mentioned earlier. If such ink dries immediately next to the edge, there is some likelihood that it will never transfer to a sheet of print medium; but if it dries actually on the edge, then there is a fair likelihood that it will be brushed off onto the medium.

As will now be understood, running-minimizing means in accordance with our invention actually can operate in part by controlling the relative rates of liquid running vs. liquid drying.

Next we come to our preferences as to the "transfer-minimizing means" associated with the third main aspect of the invention. These preferably comprise serrations, formed in the edge of the guide means, that raise most of the edge out of contact with the print medium—so that even some liquid accumulation along much of the edge may escape being transfered to the medium.

As can now be seen, serration is particularly useful in that it contributes to operation of:

- the deposition-minimizing means (by air-flow enhancement that carries ink past the dead air at the edge),
- the liquid-running minimizing means (also by air-flow enhancement—but in its role of promoting drying), and
- the transfer-minimizing means (by elevating nearly all of the guide-means edge out of contact with the print medium).

All of the foregoing operational principles and advantages, and others, of the present invention will be more fully appreciated upon consideration of the following detailed description, with reference to the appended drawings, of which:

DETAILED DESCRIPTION OF THE PREFERRED EMBODIMENTS

As FIGS. 1 through 7 show, in preferred embodiments the invention provides a guide plate 21 that is mounted preferably to the underside, or in any event below, an adjacent plenum cover 50. The guide plate 21 includes a generally horizontal mounting panel **21*h*, and very shallowly downward-angled edge panel 21*a* with serrations 21*s* and tips 21*t***. (No steeply angled panel is present.)

This angled panel **21*a* is spring-mounted to press very lightly though firmly on the printing medium 30. A rear panel 21*r*** serves to stiffen or rigidify the guide plate.

A section **50*r* of the plenum cover 50, roughly several centimeters from the print zone Z, is bent upward and accommodates the stiffening panel 21*r* of the guide plate. This processing leaves a narrow window 50*w* in the plenum cover 50**.

Figure 1:
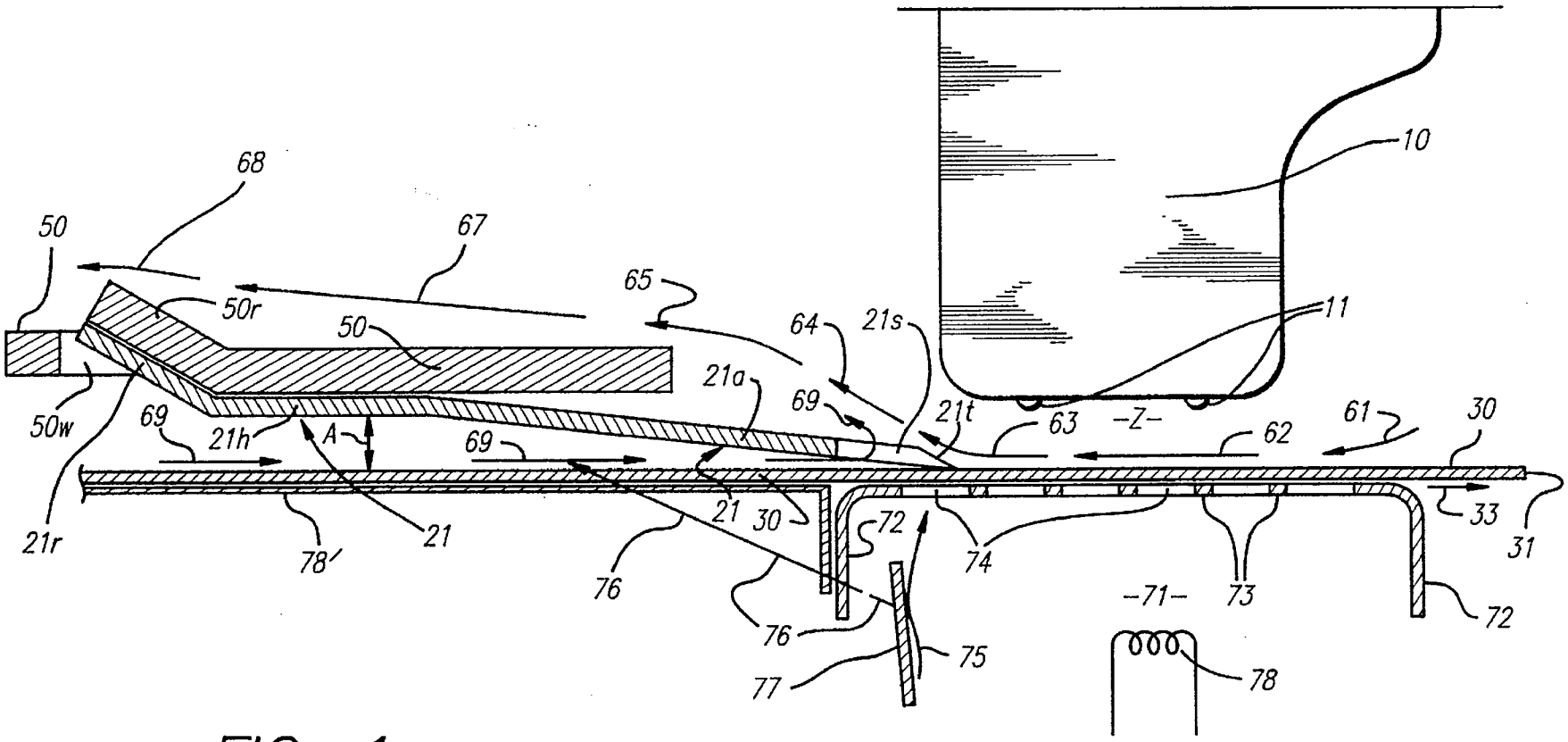
FIG. 1 is a highly schematic or conceptual side-elevation sketch in longitudinal section—not to scale, and with very greatly exaggerated thicknesses of all features that appear in section—of a preferred embodiment of the invention, showing a piece of printing medium passing through the printing system (this drawing shows the system as if cut away at 80 and with the central portion omitted)
Figure 2:
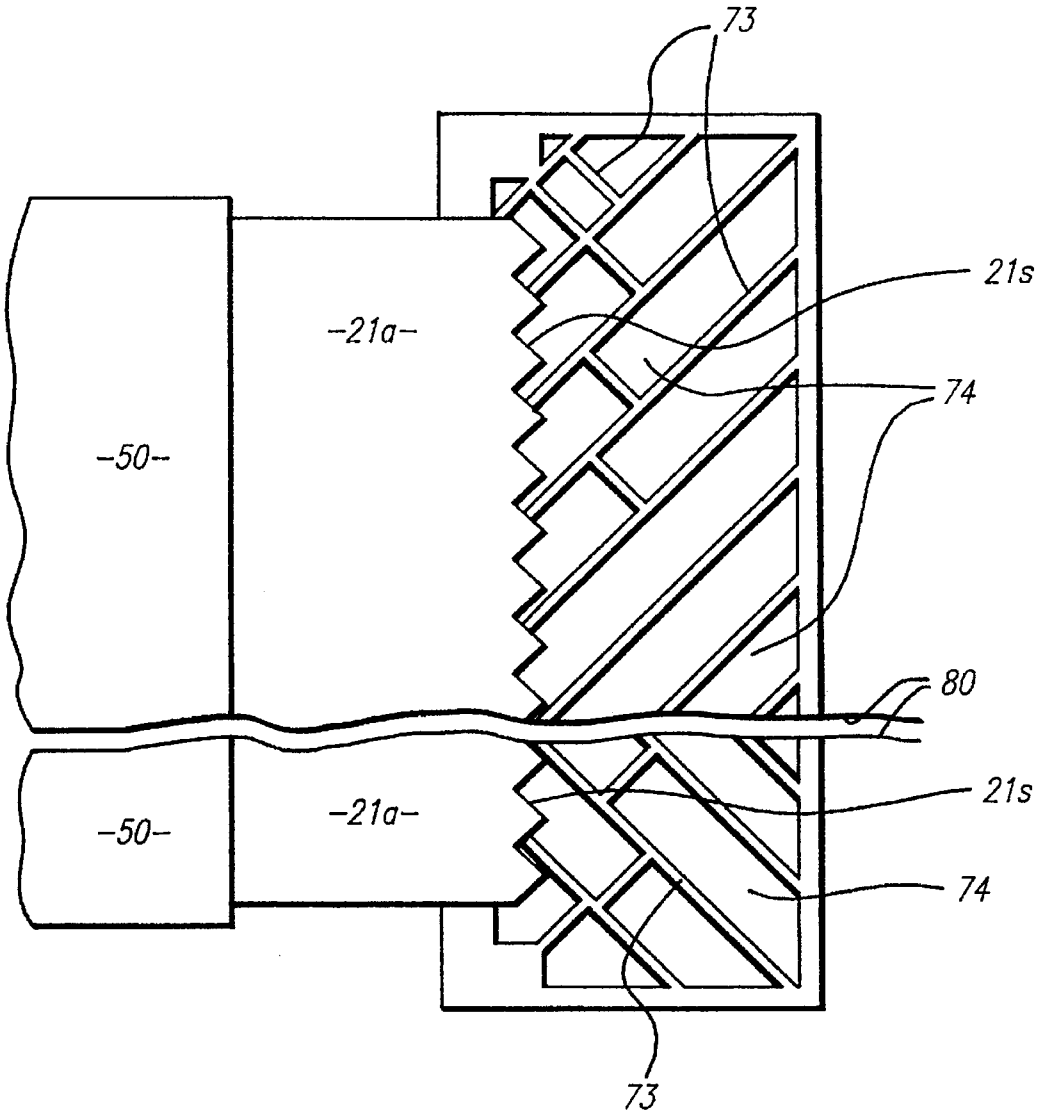
FIG. 2 is a likewise schematic or conceptual plan view—central portions cut away and omitted—of the FIG. 1 embodiment, but with no printing medium in the system.
Figure 3:
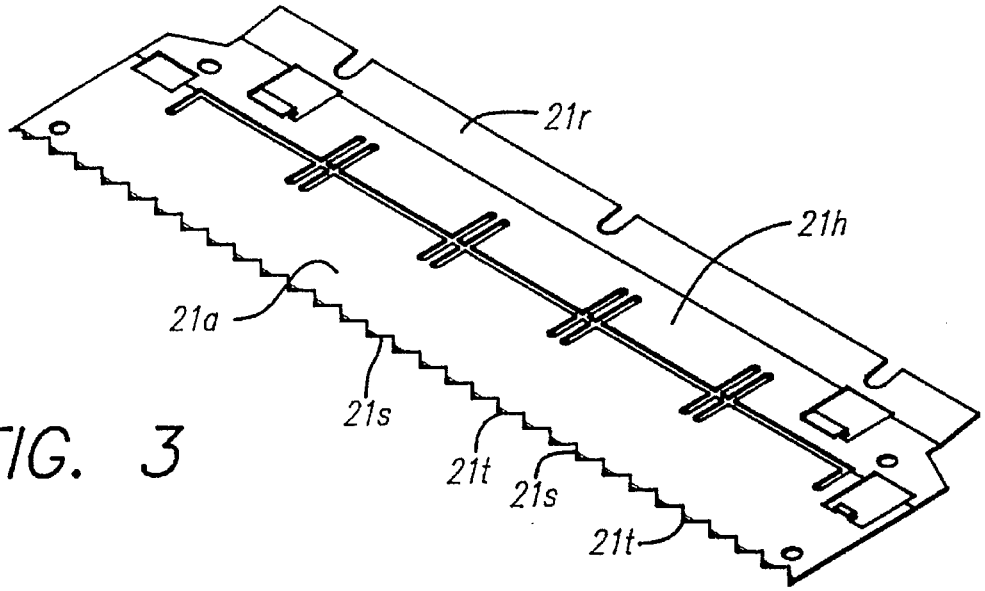
FIG. 3 is a perspective view, drawn to scale, of the central guide plate of the same embodiment.
Figure 4:
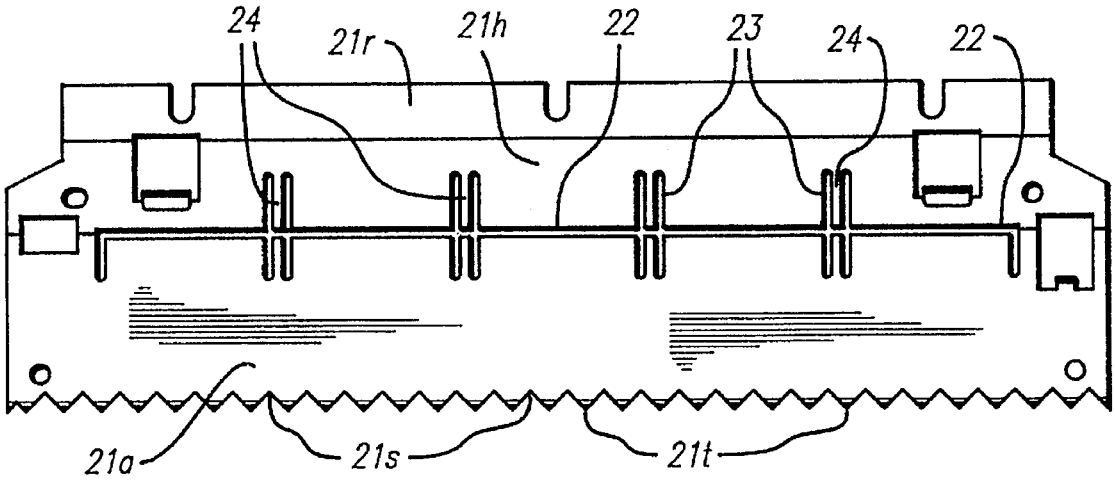
FIG. 4 is a like plan view of the plate.
Figure 5:
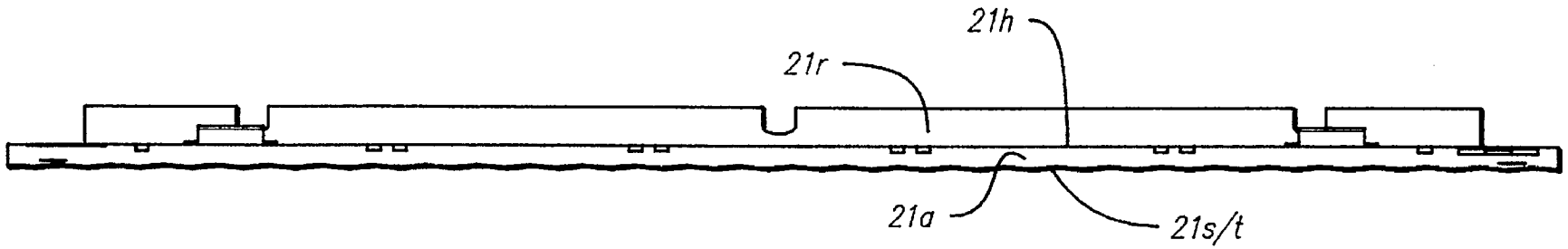
FIG. 5 is a like front elevation of the same plate.
Figure 6:
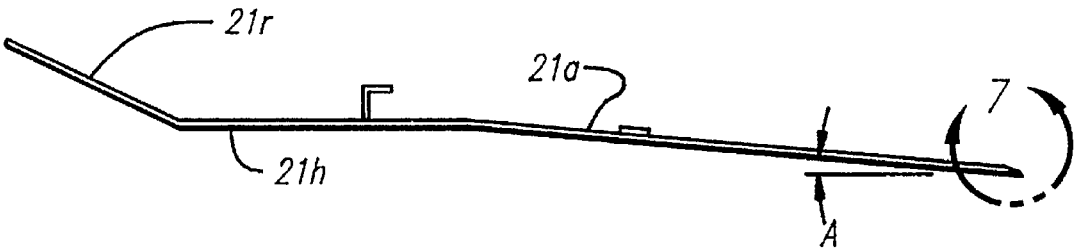
FIG. 6 is a like side elevation of the plate.

The medium advances (from left to right in FIGS. 1 and 2) above a supporting grill 73, with apertures 74, and beneath the pens 10—while the pens 10 traverse along a direction which in FIG. 1 is in and out of the plane of the paper.

The pens 10 meanwhile eject ink from nozzles 11 to form desired images on the top surface of the print medium 30, in the print zone Z. Flexible thin plastic fingers (not shown), below the guide plate help guide the leading edge 31 of the print medium smoothly under the angled panel **21*a***—and thence very reliably under the pens.

A preheater 78' and heater 78 shown schematically to the left of and below the supporting grill 73 are provided mainly to predry the print medium and to speed drying of ink deposited on the medium 30 to form a desired image. In accordance with the present invention, however, the preheater 78' and heater 78 are also turned to the task of speeding the drying of ink that deposits—undesirably—onto the guide plate 21.

Air 61–68 is moved slowly and gently from right toward left (as drawn in FIGS. 1 and 2) to carry away waste ink spray as droplets, and possibly components of the ink formulation in vapor form. This air movement is provided by a blower—not shown, but along a path that begins with the plenum structure 50 at left in the drawings—which sucks air away from the unprotected and already-imprinted regions of the print medium 30 and into the plenum structure 50.

The guide-plate edge or tips 21*t* preferably are coined or ground down to a fine thickness, thereby reducing the surface area for deposition and minimizing the dead-air space formed by the edge functioning as a wall. The plate 21 is of stainless steel, and its resilience—particularly as to the vertical direction of movement of the angled panel 21*a* for the desired print-medium-retaining action—is enhanced and adjusted to precisely a desired degree.

This enhancement and adjustment are provided by a pattern of transverse slits 22 and longitudinal slits 23, which define thin longitudinal strips 24 serving as springs. This system also localizes the vertical flexure along, roughly, a line or region roughly 3 cm (1¼ inch) from the guide edge 21*t*—between the horizontal and angled panels 21*h*, 21*a*—while preventing lateral pivoting or rotation of that portion 21*a* of the guide 21.

Serrations 21*s* are formed at the edge 21*s*/21*t* of the guide plate 21, with one object of enhancing air flow across the guide-plate edge. It is difficult to say whether a prime mechanism for such enhancement is (1) favorable influence on the ratio of laminar to turbulent flow 63 over the plate edge 21*s*/21*t*; or (2) enabling of an updraft 69 from ambient, via the space beneath the guide plate, to join the primary air flow 61–65 along the top of the print medium and into 67 the plenum structure 50; or (3) both these effects; or (4) still other effects.

Figure 7:
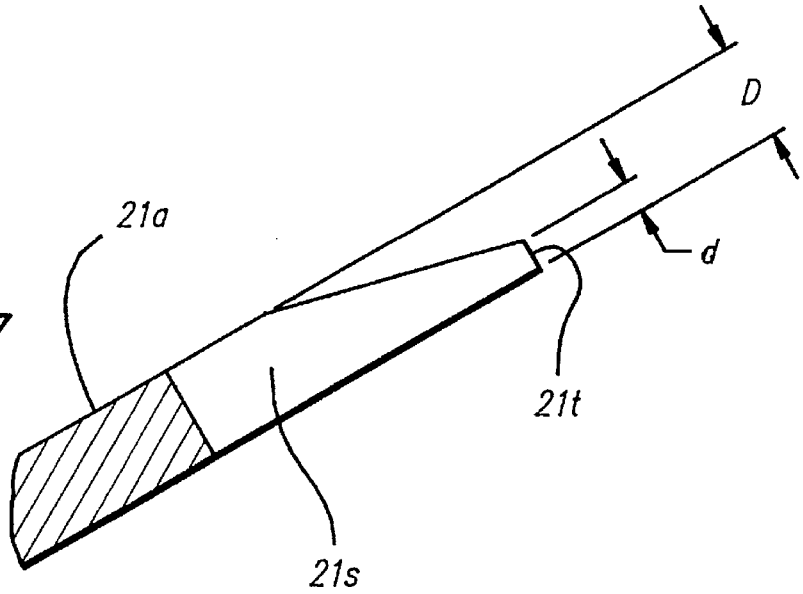
FIG. 7 is a side elevation, greatly enlarged, of the part of the plate identified in FIG. 6 by the line 7—7.

In regard to the possible mechanism of an air updraft 69 through the serrations 21*s*, as can be appreciated from comparison of FIGS. 1 and 7 no such mechanism is unavailable in earlier configurations when a piece of printing medium 30 is present in the system. Under those circumstances in earlier configurations the medium 30 and straight edge 121*t* together obstruct air flow from the undersurface of the plate 121 into the air stream 161–168 above the medium 30 and plate 121. (FIGS. 1 and 8, which include the piece of printing medium 30, may accordingly make this relationship more clear than FIGS. 2 and 9.)

The effectiveness of our invention does not depend upon determining which of the four above-enumerated theoretical interpretations (or combination of them) is correct. Observation of the finished apparatus and its printed images makes clear that the serrations 21*s*—by whatever mechanism—have a strong and apparently beneficial effect on the system operation.

More specifically, such observation reveals a remaining pattern (not shown) of ink deposition on the top of the guide plate, when all the elements of the present invention are in use together. This pattern includes very conspicuous narrow longitudinal streamers or fingers of ink that are consistently aligned along the guide plate with the serration tips, respectively.

These streamers in their entirety, at least after printing of some one hundred fifty to two hundred sheets, using the invention, are well-separated (along the direction 33 of print-medium 30 movement) from the serrated edge 21*s* and tips 21*t*. The ink deposition in the areas between streamers—which is to say, aligned with the cutaway areas 21*s* between serration tips 21*t*—is even further separated from the serrated edge than the streamers are. Hence the serrations 21*s* very evidently affect the air flow 63, 64 across the edge 21*s*, 21*t* in a significant way, a way which appears to be favorable.

To the extent that an updraft 69 mechanism is operative, additional favorable results are thought to include particularly effective drying along most of the edge—i. e., again in the cut-away portions 21*s*, between the serration tips 21*t*. As will be understood this effect is in addition to introduction of an upward velocity component (not shown) to further smoothly lift the stream of ink vapor away from the edge—and so to minimize or help dissipate formation of dead air at the interface.

A relatively small amount of ink spray which does deposit along and near the edge 21*s*/21*t* tends to dry very quickly. If desired for esthetic reasons—or in cases of rather heavy ink usage in which adverse quantities of ink eventually migrate near or to the edge—an operator of the equipment can periodically wipe away this ink deposit.

It appears to us that the operator can do so much more effectively than before. This improvement is due to the fact that nearly all the edge of the plate is now defined along the portions 21*s* of the serrations that are drawn upward and rearward (relative to the medium-advance direction), out of contact with the medium 30 and therefore more accessible for cleaning efforts.

Representative approximate dimensions for the guide plate 21 in the preferred embodiment are collected here:

| | cm | inch |
|---|---|---|
| width (transverse to the medium 30) | 18.4 | 7.2 |
| length (parallel to the medium 30, from the stiffening-panel 24r rear edge to the serration tips 21t) | 5.5 | 2.2 |
| thickness of the body 21r, 21h | 0.02 | 0.008 |
| length of the: | | |
| angled edge panel 21a | 3.0 | 1.2 |
| horizontal panel 21h | 1.4 | 0.55 |
| stiffener (rear) panel 21r | 1.1 | 0.43 |
| width of each spring 24 | 0.25 | 0.1 |
| spacing between adjacent springs 24 | 2.9 | 1.1 |
| length of each spring 24 | 1.8 | 0.7 |
| number of serrations (cutouts) 21s | 24 | 24 |
| serration 21s periodicity | 0.8 | 0.3 |
| serration 21s depth | 0.3 | 0.11 |
| radius (about a vertical axis) of the serration tips 21t | 0.03 | 0.01. |

The upper steeply angled panel of the earlier configurations is entirely eliminated. Liquid accumulation due to rapid flow down that panel is correspondingly avoided.

The edge panel 21*a* of the guide plate 212 is advantageously at a very shallow—but nonzero—angle A to the horizontal. In some contexts the term "very shallow" might be regarded as merely a relative concept and left to subjective considerations, but that is not so in this case as the value of the angle is preferably selected on the basis of objective criteria as follows.

We believe that the panel 21*a* should not be horizontal, as that would remove the beneficial effects of the serrations in raising the cut-away portions 21*s* of the edge out of contact with the medium 30. Use of a horizontal panel could also render very difficult the achievement of good, uniform control of the vertical spring force against the medium 30.

On the other hand, to provide improvement from the earlier configurations discussed above, this angle A—when the edge panel 21*a* is not deflected by contact with the supporting grill 73 or the printing medium 30—is advantageously made less than the eight to nine degrees of those earlier configurations. (As will be understood, to determine the angle of the panel 21*a* relative to the horizontal when the edge is not deflected by contact with the grill 73 or medium 30, it is necessary to consider a free-standing guide plate 21 held with its mounting panel 21*h* at the angle (e. g,. here nominally horizontal) which that panel 21*h* assumes when in assembled position against the plenum cover 50.)

Further in order to make a significant difference the edge angle A, when the edge panel 21*a* is not deflected by contact with the grill or medium, is preferably less than a value that may likely be critical, about six to seven degrees. The criticality in this regard arises from a tradeoff or compromise.

One consideration is the need for an angled, nonhorizontal panel 21*a*; a contrary consideration is the adverse effects of steep angles. We consider an ideal value to be approximately six degrees—or, when the angled edge panel 21*a* is deflected by contact with the grill 73 or medium 30, approximately four to five degrees.

Analogously the guide-plate edge and particularly tips 21*t* in accordance with our invention should have a very fine vertical dimension d (FIG. 7). This terminology does not leave the value of the dimension as a relative or subjective concept, for as a practical matter and for purposes of this document we mean a dimension selected in accordance with a tradeoff.

On one side of this tradeoff is the desirability of minimizing the height d of the edge and particularly tips 21*t*. This consideration has aerodynamic and "target"—minimization ramifications as previously explained.

Primary considerations on the other side of the tradeoff are, primarily, the cost of producing a very thin edge or tips 21*t* and, secondarily, the need for some mechanical or structural integrity in holding down the printing medium. Thus for example an edge height d of 0.03 mm (0.0012 inch)—for each serration tip 21*t*—is readily provided by grinding, but is considerably more expensive than an edge height d of 0.06 mm (0.0024 inch) that can be obtained by coining (an impact process).

Our preference is for the coined edge, which turns out to serve adequately, at least when used in conjunction with the several other features described in this document. To make an improvement over earlier configurations in this regard, the vertical dimension d of the tips should be significantly less than about 0.2 mm (0.008 inch)—which was the edge height in earlier configurations, the same as the full thickness D (FIG. 7) of the stock.

Further to optimize this improvement with respect to performance, the dimension d should be less than a value, which may likely be critical, of about 0.1 mm (0.0.004 inch). We consider the ideal value, taking cost into account, to be the above-mentioned 0.06 mm (0.0024 inch) for a coined edge.

We regard it as particularly useful to attach the guide means 21 at the undersurface of the plenum cover 50—or in any event for this purpose equivalently below the cover—rather than above the cover as in earlier configurations. In the earlier geometries the cover 50 tended to insulate the guide plate 21 from the preheater 78' and heater 78, thereby discarding the potentially beneficial effects of heating upon the reevaporation of liquid-ink components from the plate 21.

As mentioned in a preceding section, we prefer in this regard to dispose substantially the entire guide means 21 generally exposed to heat from the preheater 78' and ink-drying heater 78. By this we mean to encompass, among others, configurations in which the plenum cover 50 is not interposed to insulate the guide means 21 from the preheater 78' and the heater 78.

Figure 8:
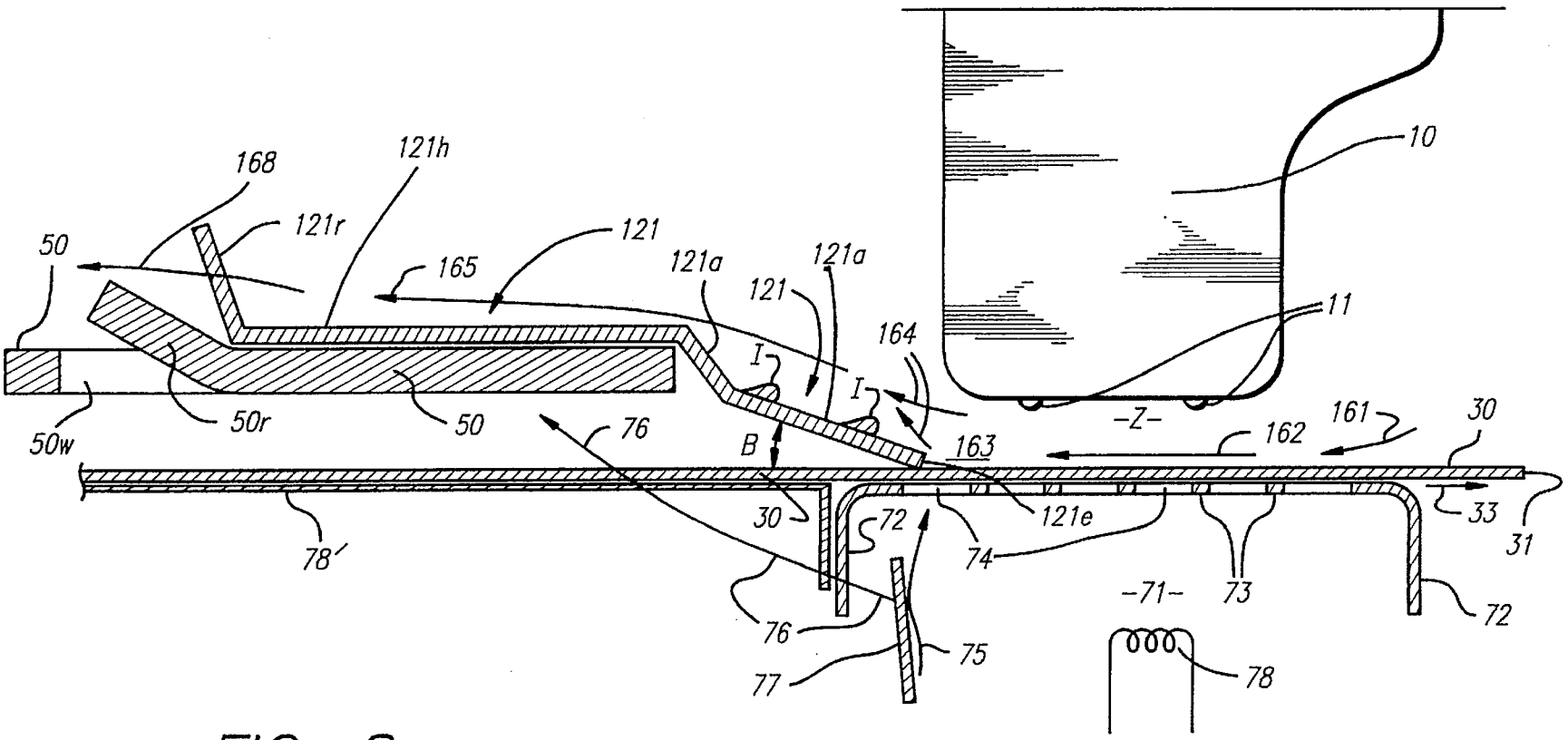
FIG. 8 is a view like FIG. 1 but showing an earlier configuration of a guide plate in the same print zone.
Figure 9:
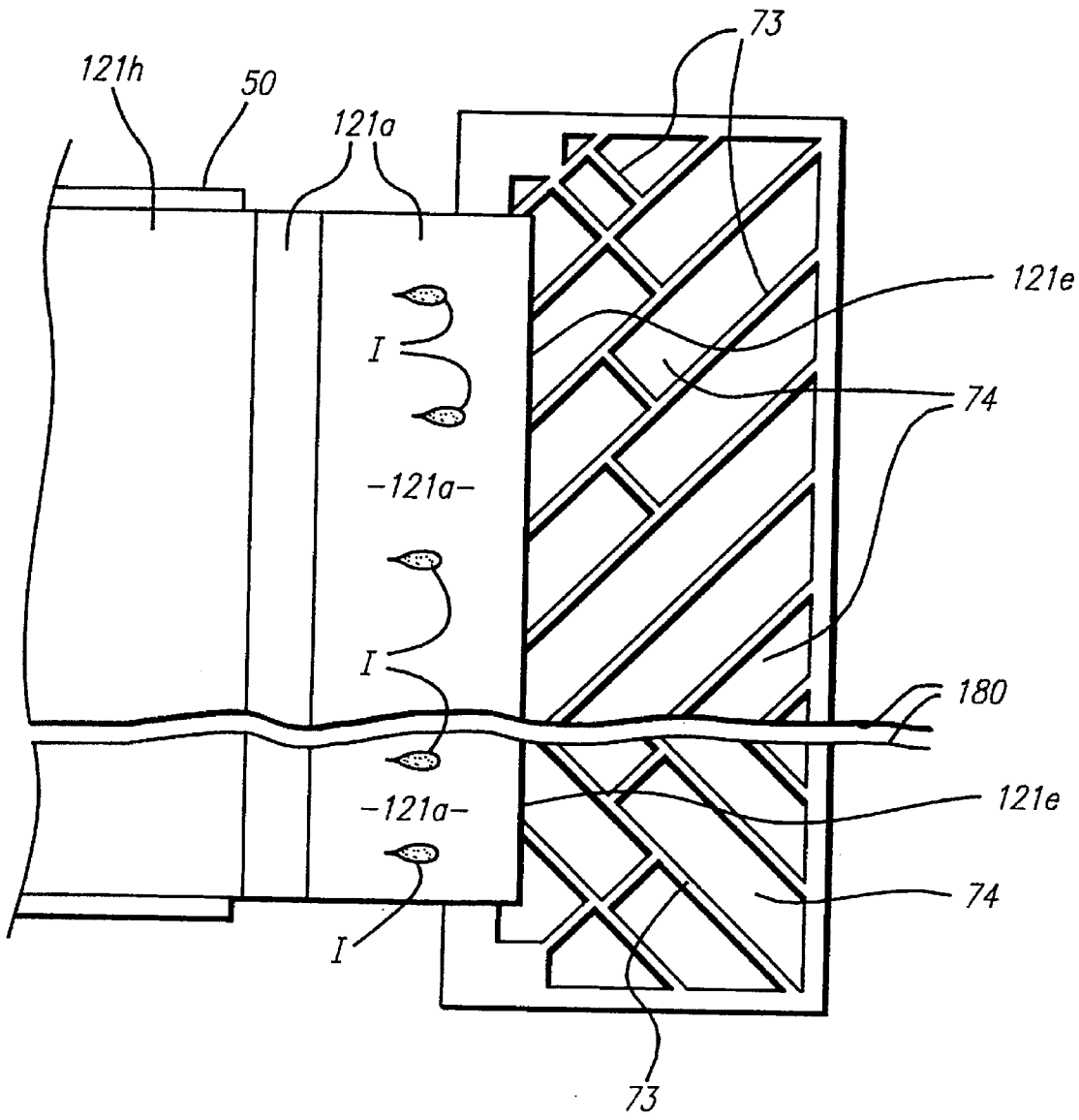
FIG. 9 is a view like FIG. 2 but showing the FIG. 8 guide plate—this drawing like FIG. 2 being cut away at 180 and with the central portion omitted.

As can be seem from FIGS. 1 and 8, the heater 78 has a compartment wall 72, 77 of its own which to some extent does shield the guide means 21 from exposure to the heater 78 itself, directly. In accordance with our invention, however, the guide means 21 are exposed to heat 76 radiated (and convected) from the wall 72, 77, as well as whatever heat may issue through the support grill 73 and from the preheater 78'.

It will also be recognized that during much of the system operation some piece of printing medium 30 is interposed between the heater 78 and the guide means 21. For present purposes, however, the print medium 30 is not always present and is not an effective insulator; thus substantially the entire guide means are effectively, adequately warmed by heat 76 issuing despite the presence of the medium 30.

In configurations not incorporating any of the features of the present invention, objectionable marking of the print medium 30 was seen regularly after printing as few as five pages. Furthermore, wiping the accumulated ink from the guide-plate edge 121*e* was very awkward and relatively ineffective because the entire edge 121*e* (FIG. 8) was pressed against the support grill 73 or print medium 30.

In practice of the present invention that figure is now elevated well beyond two hundred sheets. In addition, as mentioned earlier operator efforts to clean the plate are significantly facilitated by the function of the serrations 21*s* in moving most or nearly all of the guide-plate edge up away from the support 73 or medium 30.

While various examples and embodiments of the invention have been shown and described, it will be appreciated by those skilled in the art that the spirit and scope of the invention are not limited to the specific description and drawings herein, but extend to various modifications and changes all as set forth in the following claims.

We claim:

1. Apparatus for printing images, by marking with a liquid-base ink, on a printing medium; said apparatus comprising:

means for supporting such medium;

a marking head disposed for marking on such medium;

means for engaging such medium and for advancing such medium, in a particular direction, past the marking head;

guide means, having a print-medium-contacting edge, for vertically restraining such medium in an area that is upstream from the marking head in relation to said particular direction of medium advance;

means for establishing, above such medium and said guide means, air flow to carry airborne waste ink away from the marking head in a direction that is counter to said particular direction of medium advance; and means for minimizing deposition of ink from said air flow onto the guide means.

2. The apparatus of claim 1, wherein:

the deposition-avoiding means comprise means for enhancing air flow past the guide-means edge.

3. The apparatus of claim 2, wherein:

the air-flow enhancing means comprise serrations defined in the guide-means edge.

4. The apparatus of claim 3, wherein the serrations enhance said air flow by:

enabling updraft of air between opposed surfaces of the guide means, tending to lift said air flow above the edge; or promoting a relatively favorable balance between laminar and turbulent flow near the edge; or both.

5. The apparatus of claim 2, wherein:

the air-flow enhancing means further comprise a very fine vertical dimension of the edge.

6. The apparatus of claim 5, wherein:

the vertical dimension of the edge is significantly less than about 0.2 mm (0.008 inch).

7. The apparatus of claim 6, wherein:

the vertical dimension of the edge is less than about 0.1 mm (0.004 inch).

8. The apparatus of claim 7, wherein:

the vertical dimension of the edge is on the order of 0.06 mm (0.0024 inch).

9. The apparatus of claim 1, further comprising:

means for minimizing running of liquid ink along the guide means toward the edge.

10. The apparatus of claim 9, wherein:

the liquid-running minimizing means comprise a very shallow angle of disposition of the guide-means edge, relative to the horizontal.

11. The apparatus of claim 10, wherein:

said angle, when the edge is not deflected by contact with the support means or with such printing medium, is less than about eight to nine degrees.

12. The apparatus of claim 11, wherein:

said angle, when the edge is not deflected by contact with the support means or with such printing medium, is less than about six to seven degrees.

13. The apparatus of claim 12, wherein:

said angle, when the edge is deflected by contact with the support means or with such printing medium, is approximately four to five degrees.

14. The apparatus of claim 9, wherein:

the guide means has no portion adjacent to the edge panel and angled at more than about fifteen degrees to horizontal.

15. The apparatus of claim 9:

further comprising a preheater and heater for predrying such print medium and for applying heat to such print medium, at a print zone, to promote drying of ink on the printing medium; and wherein the liquid-running minimizing means further comprise a disposition of substantially the entire guide means generally exposed to heat from the preheater and ink-drying heater, to promote relatively rapid drying of ink that deposits on the guide means.

16. The apparatus of claim 15:

further comprising a plenum cover disposed upstream of the marking head and above such medium; and wherein:

the preheater and ink-drying heater are below the plenum cover and below such medium;

the guide means are mounted to the plenum cover; and said disposition generally exposed to heat from the preheater and ink-drying heater comprises mounting of the guide means to the underside of the plenum cover.

17. The apparatus of claim 9, further comprising:

means for minimizing transfer of ink from the guide-means edge onto such medium.

18. The apparatus of claim 17, wherein:

the transfer-minimizing means comprise serrations, formed in the edge, that raise most of the edge out of contact with the print medium.

19. The apparatus of claim 1, further comprising:

means for minimizing transfer of ink from the guide-means edge onto such medium.

20. The apparatus of claim 19, wherein:

the transfer-minimizing means comprise serrations, formed in the edge, that raise most of the edge out of contact with the print medium.

21. The apparatus of claim 1, further comprising:

means for minimizing transfer of ink from the guide-means edge onto such medium.

22. The apparatus of claim 21, wherein:

the transfer-minimizing means comprise serrations, formed in the edge, that raise most of the edge out of contact with the print medium.

23. The apparatus of claim 21, wherein:

the transfer-minimizing means comprise serrations, formed in the edge, that raise most of the edge out of contact with the print medium.

24. Apparatus for printing images, by marking with a liquid-base ink, on a printing medium; said apparatus comprising:

means for supporting such medium;

a marking head disposed for marking on such medium;

means for engaging such medium and for advancing such medium, in a particular direction, past the marking head;

guide means, having a print-medium-contacting edge, for vertically restraining such medium in an area that is upstream from the marking head in relation to said particular direction of medium advance;

means for establishing, above such medium and said guide means, air flow to carry airborne waste ink away from the marking head in a direction that is counter to said particular direction of medium advance; said guide means being subject to deposition of ink from said air flow; and means for minimizing running of liquid ink along the guide means toward the edge.

25. The apparatus of claim 24, wherein:

the liquid-running minimizing means comprise a very shallow angle of disposition of the guide-means edge, relative to the horizontal.

26. The apparatus of claim 25:

further comprising a preheater and heater for predrying such print medium and for applying heat to such print medium, at a print zone, to promote drying of ink on the printing medium; and wherein the liquid-running minimizing means further comprise a disposition of substantially the entire guide means generally exposed to heat from the preheater and ink-drying heater, to promote relatively rapid drying of ink that deposits on the guide means.

27. The apparatus of claim 25, further comprising:

means for minimizing transfer of ink from the guide-means edge onto such medium.

28. The apparatus of claim 27, wherein:

the transfer-minimizing means comprise serrations, formed in the edge, that raise most of the edge out of contact with the print medium.

29. Apparatus for printing images, by marking with a liquid-base ink, on a printing medium; said apparatus comprising:

means for supporting such medium;

a marking head disposed for marking on such medium;

means for engaging such medium and for advancing such medium, in a particular direction, past the marking head;

guide means, having a print-medium-contacting edge, for vertically restraining such medium in an area that is upstream from the marking head in relation to said particular direction of medium advance;

means for establishing, above such medium and said guide means, air flow to carry airborne waste ink away from the marking head in a direction that is counter to said particular direction of medium advance; the guide-means edge being subject to deposition of ink directly or indirectly from the air flow; and means for minimizing transfer of ink from the guide-means edge onto such medium.

30. Apparatus for printing images, by marking with a liquid-base ink, on a printing medium; said apparatus comprising:

means for supporting such medium;

a marking head disposed for marking on such medium;

means for engaging such medium and for advancing such medium, in a particular direction, past the marking head;

a plenum cover disposed upstream of the marking head in relation to said particular direction of medium advance;

guide means mounted to an undersurface of the plenum cover and having a print-medium-contacting edge, for vertically restraining such medium in an area that is upstream from the marking head in relation to said particular direction of medium advance;

means for establishing, above such medium and said guide means, air flow to carry airborne liquid-ink particles away from the marking head in a direction that is counter to said particular direction of medium advance; and serrations defined in the guide-means edge;

said edge having a very fine vertical dimension; and said edge being at a very shallow angle of disposition, relative to the horizontal.

31. The apparatus of claim 30, wherein:

an indentation forming each serration is on the order of 2 mm (0.09 inch) deep and 8 mm (0.3 inch) across; and a tip forming each serration has a radius, in approximately the horizontal dimension, on the order of 0.3 mm (0.01 inch).

32. The apparatus of claim 30, wherein:

the vertical dimension of the edge is on the order of 0.06 mm (0.0024 inch).

33. The apparatus of claim 30, wherein:

said angle, when the edge is not deflected by contact with the support means or with such printing medium, is approximately six degrees; and when the edge is deflected by contact with the support means or with such printing medium is approximately four to five degrees.

* * * * *